US008100139B2

(12) United States Patent
Chong

(10) Patent No.: US 8,100,139 B2
(45) Date of Patent: Jan. 24, 2012

(54) PROTECTIVE IMPROVEMENT ON A COLLAPSIBLE UMBRELLA

(75) Inventor: Jung Jen Chong, Fujian (CN)

(73) Assignee: Xiamen Fu Tai Umbrella Industries Ltd., Xiamen, Fujian (CN)

( * ) Notice: Subject to any disclaimer, the term of this patent is extended or adjusted under 35 U.S.C. 154(b) by 0 days.

(21) Appl. No.: 12/633,553

(22) Filed: Dec. 8, 2009

(65) Prior Publication Data

US 2010/0319739 A1 Dec. 23, 2010

(30) Foreign Application Priority Data

Jun. 22, 2009 (CN) ..... 2009 1 0112120

(51) Int. Cl.
*A45B 25/16* (2006.01)

(52) U.S. Cl. ..... 135/24

(58) Field of Classification Search ..... 135/15.1, 135/22, 24, 25.4, 25.41
See application file for complete search history.

(56) References Cited

U.S. PATENT DOCUMENTS

| | | | | |
|---|---|---|---|---|
| 3,129,715 | A * | 4/1964 | Militano et al. | 135/20.3 |
| 4,149,553 | A * | 4/1979 | Lee | 135/24 |
| 5,174,319 | A * | 12/1992 | Chou et al. | 135/20.3 |
| 5,964,237 | A * | 10/1999 | Lin | 135/114 |
| 6,810,894 | B2 * | 11/2004 | Chen | 135/22 |
| 7,168,438 | B2 * | 1/2007 | Hung | 135/24 |
| 7,461,666 | B2 * | 12/2008 | Huang | 135/22 |
| 7,798,160 | B2 * | 9/2010 | Chen | 135/24 |

* cited by examiner

*Primary Examiner* — David Dunn
*Assistant Examiner* — Noah Chandler Hawk

(57) ABSTRACT

A protective improvement on a collapsible umbrella includes a driving cord directly penetrating a base for connecting to an upper accommodation. The driving cord has its one end fixed to a pulley tackle and its other end fixed to the upper accommodation. A spacer is axially disposed inside a part of the through hole O and extends along an elongated direction of the through hole O for dividing up the part of the through hole O into two half through holes H's, and for separating the driving cord from the pulling cord to facilitate an independent and non-overlapping working space of the driving cord and the pulling cord.

5 Claims, 11 Drawing Sheets

PROTECTIVE IMPROVEMENT ON A COLLAPSIBLE UMBRELLA

BACKGROUND OF THE INVENTION

1. Field of the Invention

The present invention relates to a protective improvement on a collapsible umbrella, in particular, to a retrieving structure adapted for a protective device in a collapsible umbrella.

2. Description of the Related Art

Umbrellas are used in everyday life. There is a kind of auto-folding umbrella that automatically open and close via a button. However, the automatic operation of umbrella is merely activated on umbrella ribs; that is to say, the retrieving of the umbrella support still requires manual compressing. When in operation, if the manual compressing by a user is not completely executed at a single try, unexpected accidents can happen.

Referring to FIGS. 1, 2*a*, 2*b*, 3*a*, 3*b*, 3*c*, and 3*d* show three substantial embodiments of the existing techniques with their security concerns. Wherein, FIG. 1 shows a first embodiment of the conventional techniques. FIGS. 2*a* and 2*b* offer a second embodiment of the conventional techniques with the cross-sectional views respectively showing a retrieving state in FIG. 2*a* and an opening state in FIG. 2*b* of an umbrella base. FIGS. 3*a* to 3*d* offer a third embodiment of the conventional techniques with the cross-sectional views respectively showing an opening state in 3*a* and a retrieving state in 3*c* of an umbrella base, as well as with the side cross-sectional views respectively showing 3*a* and 3*c* in 3*b* and 3*a*. Accordingly, the umbrella base 10 of the conventional techniques provides with a driving member (the driving member in FIG. 1 adopts a slippery block 64, in FIG. 2 adopts a sleeve 8, and in FIG. 3 adopts a slippery block 64), a pulley tackle 62, a clockwork spring 66, a clutch (in FIGS. 1 and 2 adopts a clutch disc 63, and in FIG. 3 adopts a ratchet 9), and a clutch spring (in FIGS. 1 and 2 adopts a clutch spring 631, and in FIG. 3 adopts a spring sheet 91). A driving cord 65 is fixed to the pulley tackle 62. One end of the driving cord 65 penetrates a space 67 defined on the base 10 for connecting to an upper accommodation. The pulley tackle 62 assists the clockwork spring 66 in storing energy while the pulley tackle 62 rotates clockwise. Whereas, when the driving cord 65 is slackened, the clockwork spring 66 would drive the pulley tackle 62 rotating counterclockwise, and the driving cord 65 could be retracted. Moreover, the clutch spring would further propel the clutch, so that the pulley tackle 62 could be tightly pressed. A one-way rotating device is disposed between the clutch and the pulley tackle 62. By the cooperation of the clutch and the pulley tackle 62, the driving cord 65 would be solely retracted by the pulley tackle 62; namely, the driving cord 65 would not be loosened. Alternatively, the driving member and the clutch could optionally contact with each other in different states of the umbrella. Namely, when the umbrella is opened, the driving member would engage with the clutch, so that the clutch would depart from the pulley tackle 62, from which the driving cord 65 would be free. In contrast, when the umbrella is closed, a buckle 54 would set the driving member free, so that the driving member would thence stop compressing the clutch. Accordingly, the clutch would densely engage with the pulley tackle 62 via the clutch spring. Also, by means of the one-way rotating device disposed between the pulley tackle 62 and the clutch, the support could merely move along the retracting direction; thus a stretching movement is unable to be accomplished. Therefore, the potential danger can be avoided. The driving cord 65 connects to the upper accommodation via the space 67 defined in the base, the driving cord 65, the exterior base, and the upper accommodation are all outwardly exposed to the outside. As a result, the driving cord 65 is vulnerable, and the preferred efficiency of the umbrella is not achieved. Moreover, the exposed driving cord 65 also facilely entangles itself with other objects of the umbrella.

SUMMARY OF THE INVENTION

Therefore, the object of the present invention is to provide a protective device in a collapsible umbrella that could be safely used with a elongated service life. Moreover, an appearance of the umbrella would not be affected. Accordingly, the disadvantages generated from a fragile driving cord disposed exteriorly could be amended and avoided.

The present invention applies the following techniques:

A retrieving structure adapted for a protective device in a collapsible umbrella comprises a driving cord having its one end fixed to a pulley tackle and having its other end fixed to an upper accommodation. Wherein, the driving cord in between the pulley tackle and the upper accommodation is hidden in a case of an umbrella support.

The driving cord drawn from the pulley tackle would sequentially pass through an interstice between a blocking member and the support and a through hole of a linking pipe for being fixed to the upper accommodation.

Preferably, a spacer is disposed inside the through hole of the linking pipe and extended along an elongated direction of the through hole.

Preferably, the spacer is disposed through a section of the linking pipe.

Preferably, the spacer adopts a piece of blocking spacer that is stretchingly disposed along the entire through hole of the linking pipe.

Preferably, the blocking member includes a buckling orifice; the collapsible umbrella further has a buckle for engaging with the buckling orifice; a first groove defined on an outer periphery of the blocking member is positioned away from the buckling orifice for the driving cord to penetrate.

Preferably, the groove is defined parallel to a different axis of the blocking member.

Preferably, the groove is defined along the entire outer periphery of the blocking member.

Preferably, the groove is defined along the partial outer periphery of the blocking member; the blocking member has an aperture defined on an end portion of the groove for communicating with an axial aperture of the blocking member.

Accordingly, the driving cord could directly penetrate the through hole of the linking pipe and fix to the upper accommodation, so the driving cord would not be exposed outside the umbrella, and the driving cord would be isolated from the exterior. Thus, the driving cord is protected inside the case and not exposed outside. Moreover, by disposing the driving cord inside the umbrella body, the integral appearance of the umbrella is more appealing. Further by means of the spacer disposed inside the linking pipe and defined along the stretching direction of the through hole for separating the pulling cord and the driving cord, the pulling cord and the driving cord work independently of each other. Thus, the function of the protective device is further promoted. Concomitantly, the groove that is disposed away from the blocking member is provided for the driving cord to pass through, and the groove could be preferably defined on the surface of the blocking member and traveled along a direction parallel to the second axis of the blocking member. Thereby, the advancing route of the driving cord inside the base becomes streamlined, which decreases the opportunity of damage the driving cord within the base.

DETAILED DESCRIPTION OF THE PREFERRED EMBODIMENTS

The present invention is carefully depicted via the following embodiment.

Figure 1:
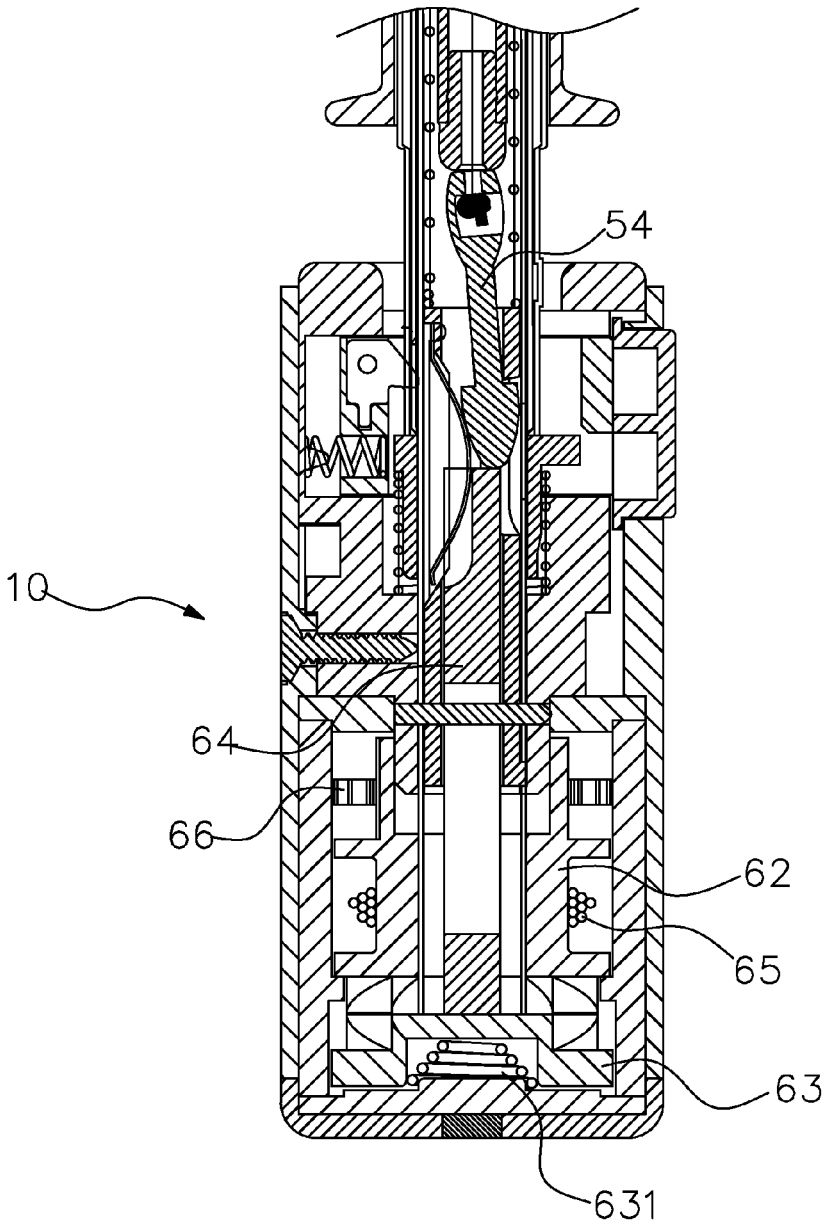
FIG. 1 Prior Art
FIG. 1 is a schematic view showing a first embodiment of a conventional protective device of the auto open and close umbrella.
Figure 2A:
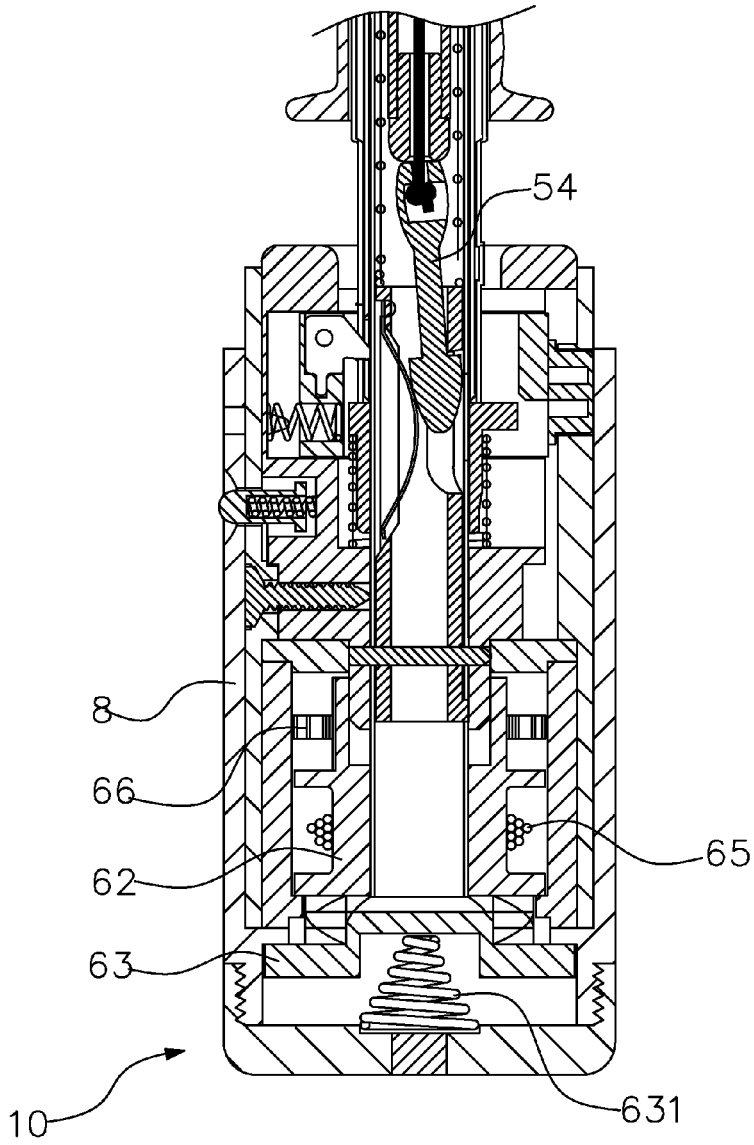
F I G. 2A Prior Art
FIG. 2A is a cross-sectional view showing a second embodiment of a conventional protective device in a base of the auto open and close umbrella in closing.
Figure 2B:
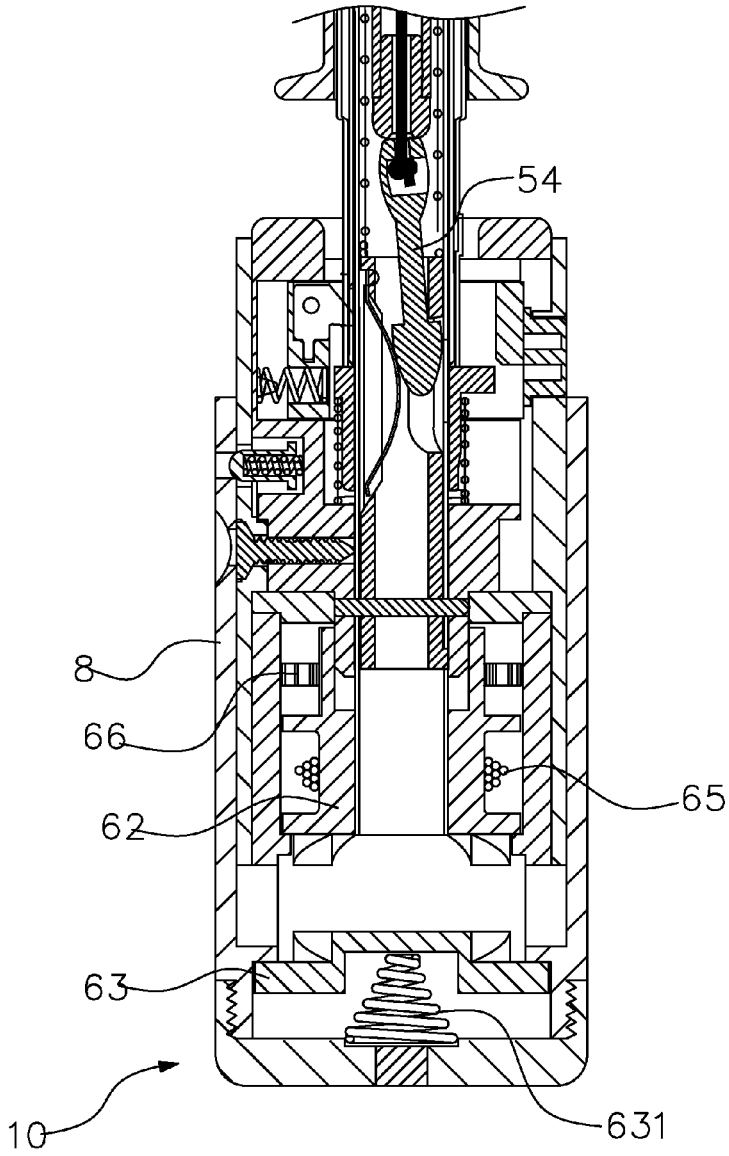
F I G. 2B Prior Art
FIG. 2B is a cross-sectional view showing the second embodiment in closing.
Figure 3B:
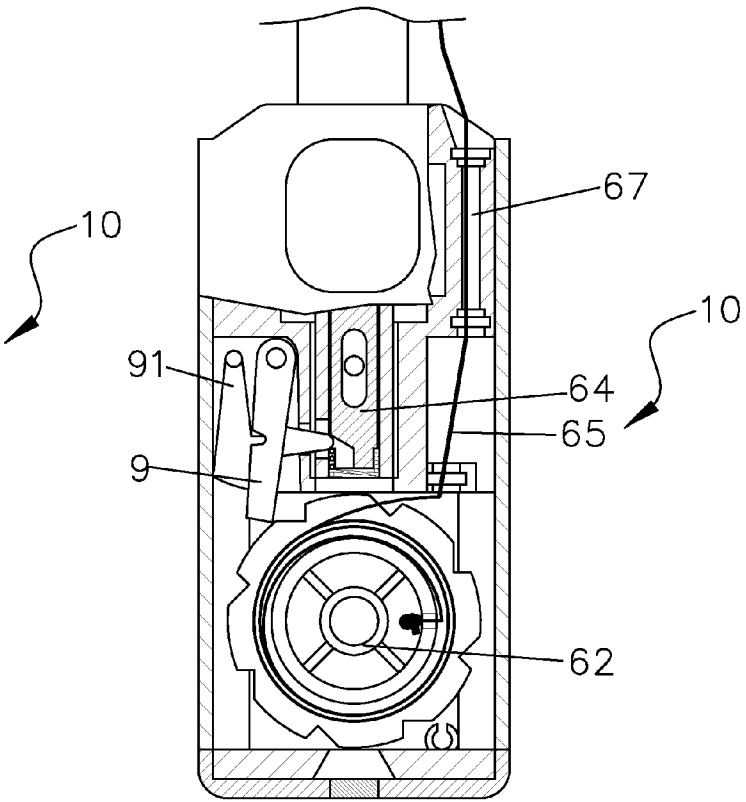
FIG. 3B Prior Art
FIG. 3B is a side cross-sectional view showing FIG. 3A.
Figure 3A:
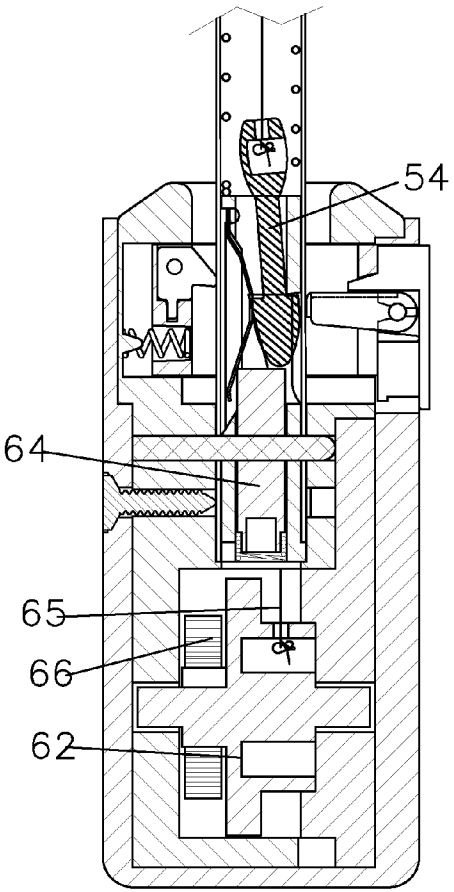
FIG. 3A Prior Art
FIG. 3A is a cross-sectional view showing a third embodiment of a conventional protective device in a base of the auto open and close umbrella in opening.
Figure 3D:
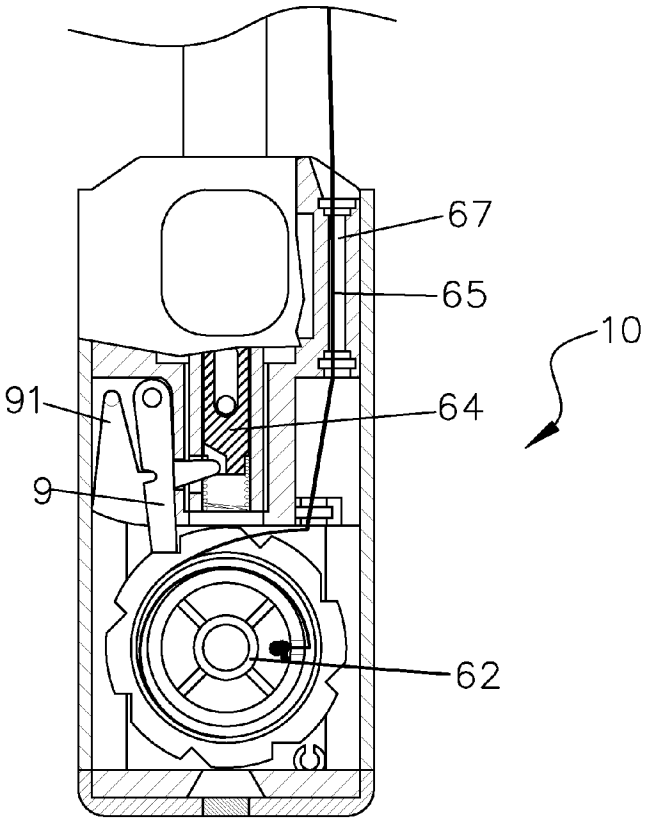
FIG. 3D Prior Art
FIG. 3D is a side cross-sectional view showing FIG. 3C.
Figure 3C:
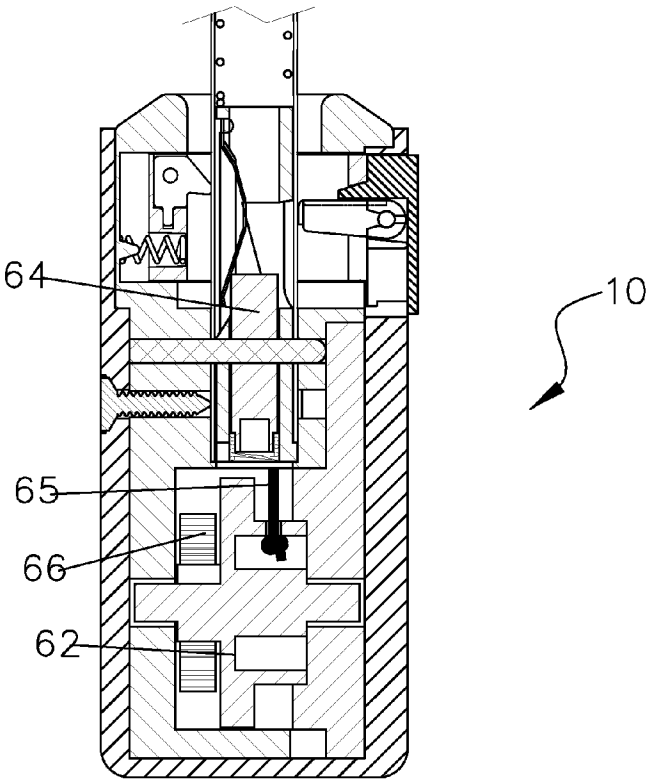
FIG. 3C Prior Art
FIG. 3C is a cross-sectional view showing the third embodiment of a conventional protective device in a base of the auto open and close umbrella in closing.
Figure 4:
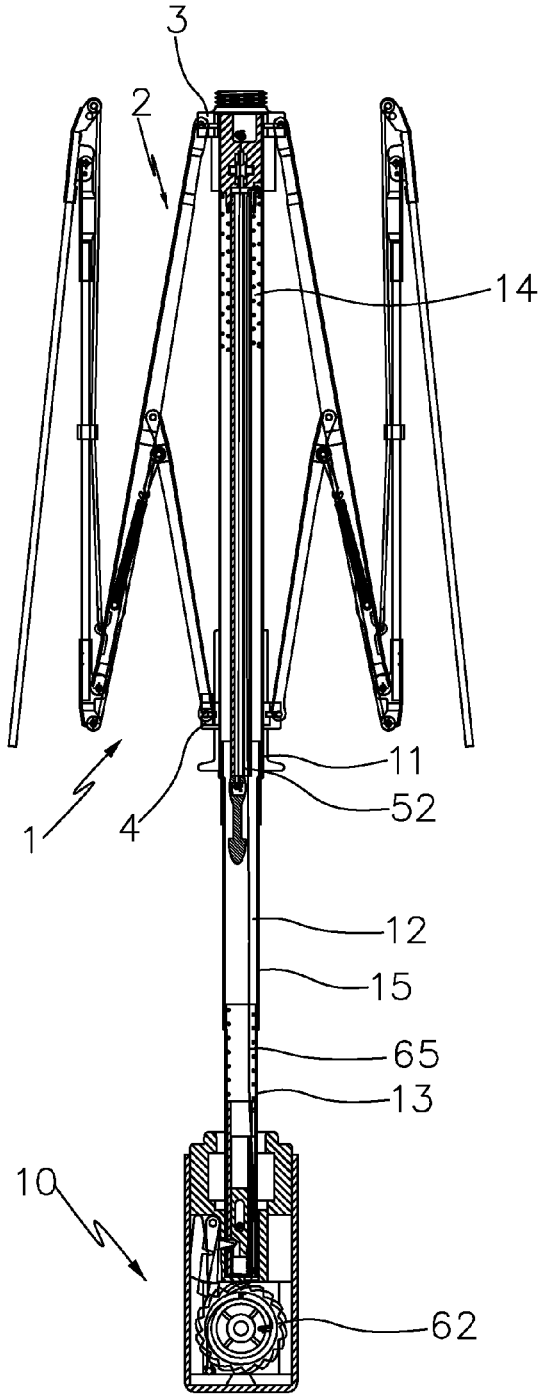
FIG. 4 is a schematic view showing the present invention in closing.

Referring to FIG. 4, an automatic open-and-close umbrella comprises a telescopic umbrella support 1 and collapsible umbrella ribs 2; the support 1 includes a lower accommodation 4 slipperily disposed thereon, an upper accommodation 3 disposed on a top end thereof, and a base 10 disposed at a lower end thereof. The umbrella ribs 2 are connected with the support 1 through the upper accommodation 3, and the lower accommodation 4. The support 1 includes an outer pipe 11, a center pipe 12, and an inner pipe 13 telescopically coupled with each other. Moreover, the support 1 further includes a propelling spring 14 disposed therein for correspondingly driving the outer pipe 11, the center pipe 12, and the inner pipe 13. The upper accommodation 3 is disposed at a top portion of the outer pipe 11, the base 10 is disposed at a bottom portion of the inner pipe 13, and the lower accommodation 4 is disposed outside the outer pipe 11. Whereby, while stretching the support 1, the outer pipe 11 would be placed at the topmost position, and the inner pipe 13 would be placed at the lowermost position. Wherein, the substantial structure and the processes for opening and closing the umbrella known by the person skilled in the art are herein omitted. The detailed protective device and the retrieving structure related to the present invention would be illustrated as follows.

The description of the following techniques would tag along the third embodiment of the conventional structure. As it should be, the present invention is not limited to the third embodiment of the conventional structure; the first and second embodiments of the conventional structures or other protective devices could be optionally applied. In order to clearly explain the detailed techniques involved in the present invention, the third embodiment of the conventional structure is adopted.

Figure 6:
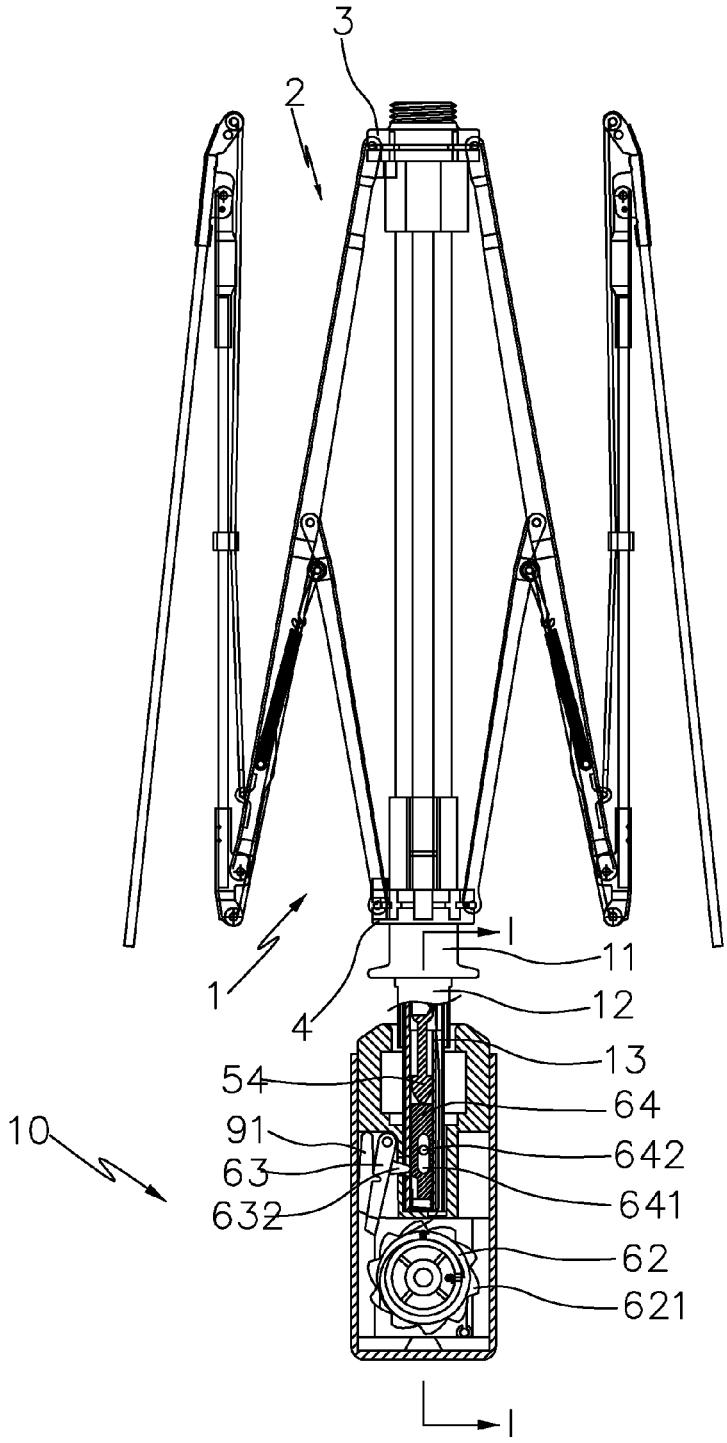
FIG. 6 is a schematic view showing the present invention in opening.
Figure 7:
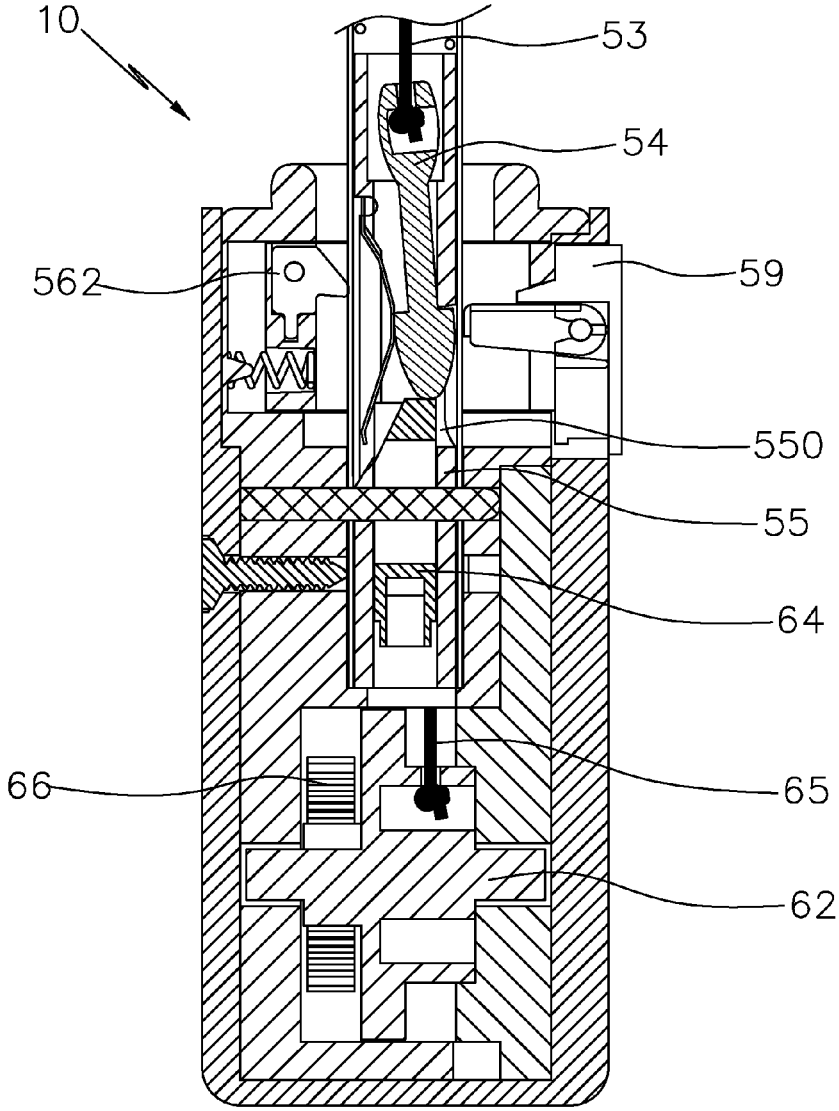
FIG. 7 is a cross-sectional view showing the I-I portion of the base in FIG. 6.
Figure 9:
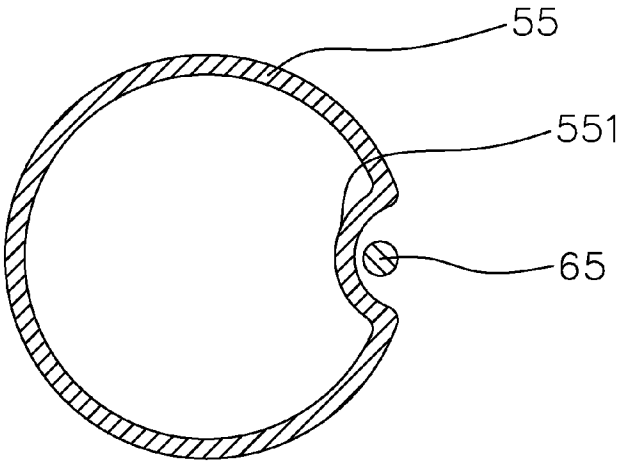
FIG. 9 is a cross-sectional view of a groove that is disposed on the surface of a blocking member.

Referring to FIGS. 6 and 7, the driving member inside the base adopts a slippery block 64 with an opening 641. Wherein, a nail 642 is inserted in the opening 641 for limiting the longitudinal movement of the slippery block 64 in the blocking member 55. The nail 642 is fixed on the base 10, and a relocating spring 643 is disposed under the slippery block 64.

When the umbrella is to be opened, a button 59 on the base 10 is pressed to let a spring knurl 562 depart from an engaging hole (not shown). Accordingly, by means of the propelling spring, the support 1 would be extended and spread, the pulling cord 53 would be pulled, and the lower accommodation 4 would be propped up, so that the umbrella ribs 2 could be stretched out. At the same time, when the buckle 54 is pressed by the slippery block 64, the slippery block 64 would further compress a protrusion 632 of clutch disc 63 for bringing a clutch disc 63 to rotate. As a result, the clutch disc 63 would squeeze a spring sheet 631, and the buckling member 54 would depart from a wheel 621 of the pulley tackle 62. Further, the driving cord 65 would be upwardly pulled by the upper accommodation 3, and the pulley 62 would be accordingly rotated, so that a spiral spring 66 could be pressed to store energy.

Figure 5:
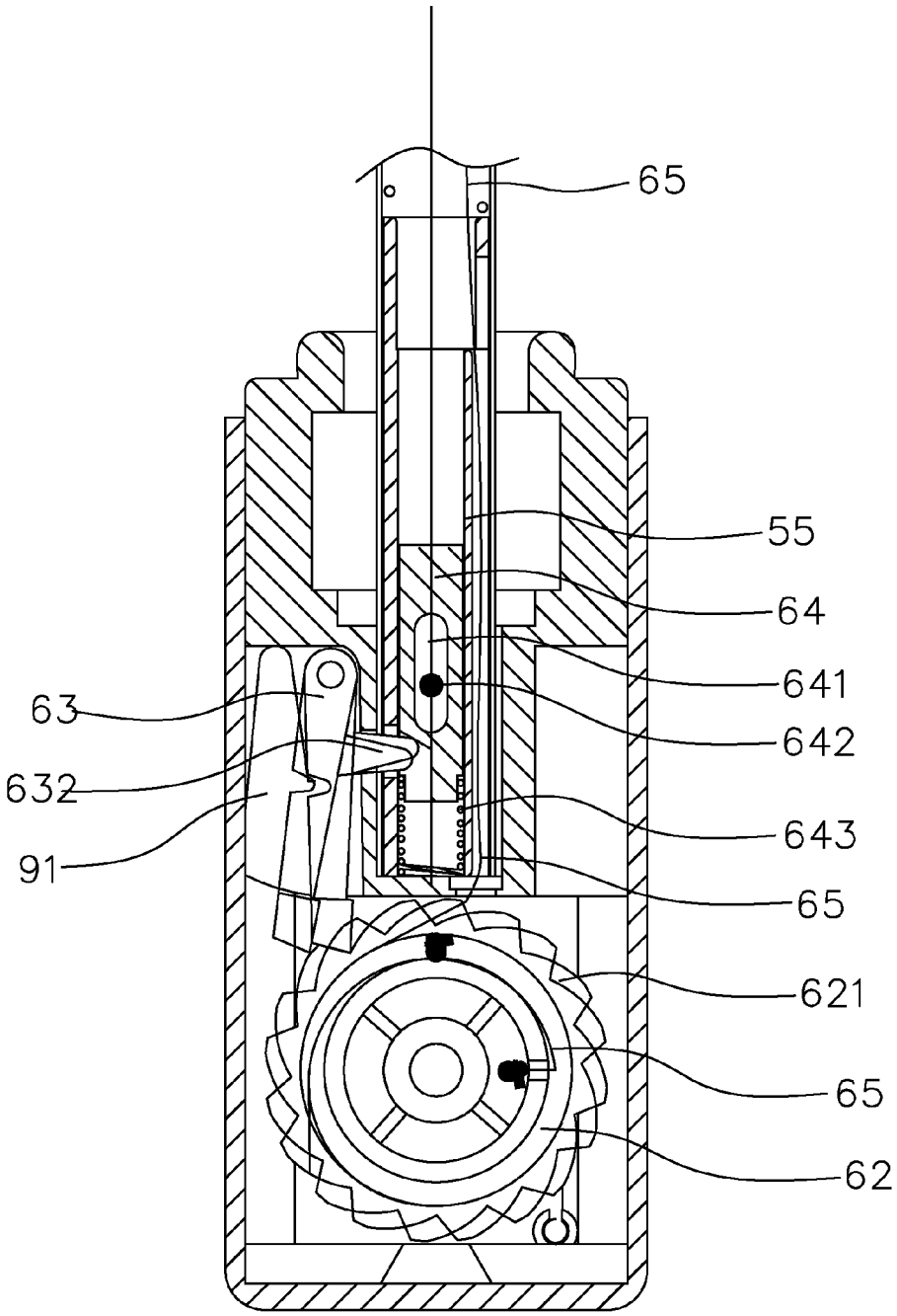
FIG. 5 is an enlarged view showing a base of the present invention.

Referring to FIGS. 4 and 5, when the umbrella is to be closed, the button 59 is pressed again to let the buckle 54 depart from a buckling orifice 550. Whereby, the pulling cord 53 would stop pulling the lower accommodation 4. Therefore, by means of the relocating spring, the lower accommodation 4 would slip downwardly, and the umbrella ribs 2 are retracted. At the same time, the buckle 54 deviates from the slippery block 64 and thence moves upward under the influence of the relocating spring 643. Accordingly, the clutch disc 63 would no longer impinge on the slippery block 64, so that the clutch disc 63 would cooperate with the wheel 621 of the pulley tackle 62 via the spring sheet 631. Referring to FIG. 7, the pulley tackle 62 could merely execute a unidirectional rotation relative to the clutch disc 63, for instance of a counterclockwise rotation as shown by FIG. 7. As a result, while compressing the support 1, the pulley tackle 62 could rotatively retract the driving cord 65 via the spiral spring 66. If users loose their grip in time of compressing the support 1, the driving cord 65 would be tightened, and the pulley tackle 62 could not rotate oppositely in view of the restriction of the clutch disc 63. Therefore, by means of the tightened driving cord 65, the support 1 would not bounce, and a protective effect is achieved.

The present invention comprises the driving cord 65 having its one end fixed to the pulley tackle 62 and having its other end fixed to the upper accommodation 3 through the space inside the support 1. Wherein, the driving cord 65 would be hidden in a case of the umbrella support 1. Thus, the driving cord 65 could be prevented from damage during the using, so that the protective device would still execute its function well. Preferably, the integral appearance of the umbrella could be maintained. As it should be, after drawn from the pulley tackle 62, the driving cord 65 would sequentially pass through an interstice between the blocking member 55 and the support 1 and a through hole of the linking pipe 52.

Figure 8:
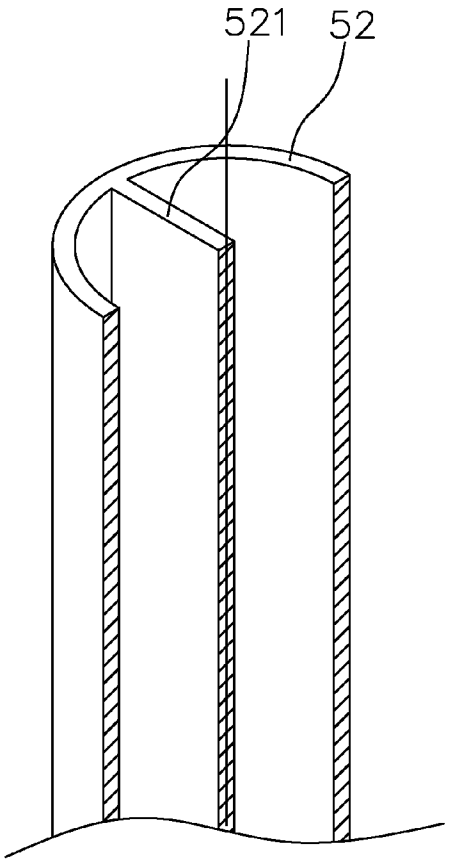
FIG. 8 is a cross-sectional view showing a continuous spacer disposed inside a linking pipe of the present invention.

There are two cords in the linking pipe 52, the pulling cord 53 and the driving cord 65, and the functions of the two cords are different. Thus, in order to separate the two cords, a spacer is further disposed in the through hole of the linking pipe 52 and extended along an elongated direction of the through hole. Namely, the through hole of the linking pipe is divided into two holes. The spacer is preferably disposed through a first axis of the linking pipe 52, so that two half holes would be averagely defined in the linking pipe 52. Also, referring to FIG. 8, for a handy processing, the spacer adopts a piece of blocking spacer 521 that is stretchingly disposed along the entire through hole of the linking pipe 52. Favorably for saving material, the blocking spacer 521 could adopt a disconnected type. Other substantial arrangements of the blocking spacer 521 are not limited as long as the pulling cord 53 and the driving cord 65 are ensured not to interfere with one another.

Figure 10:
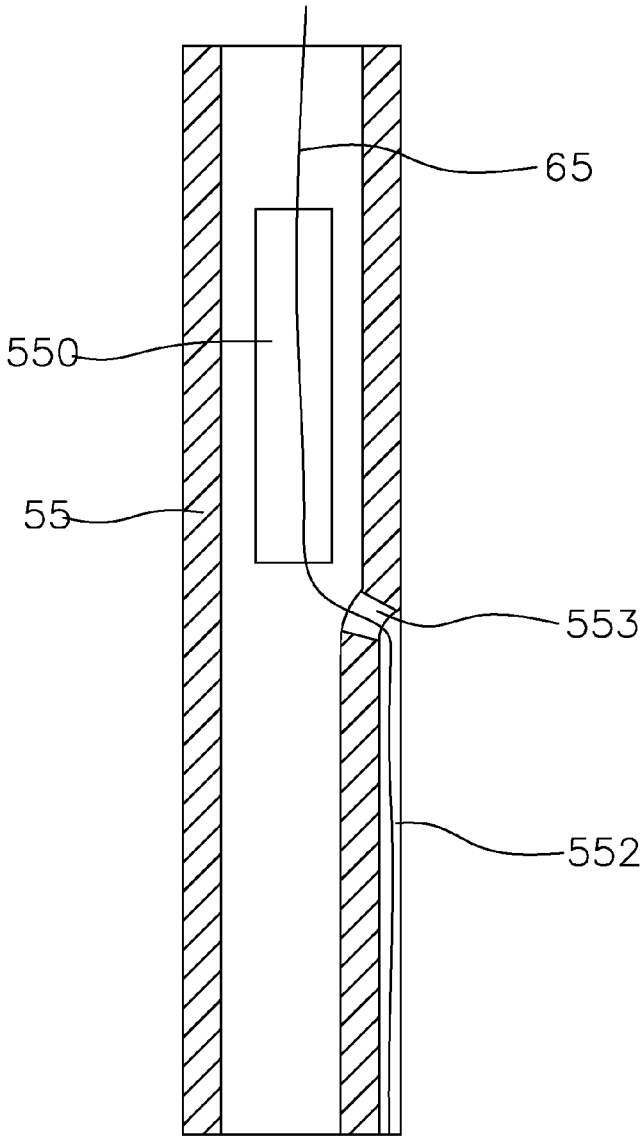
FIG. 10 is a cross-sectional view of a partial groove that is disposed on the surface of a blocking member.

In order to let the driving cord 65 have a smooth penetration in the base 10, a third axis of the pulley tackle 62 is perpendicular to the first axis of the linking pipe 52. As shown in FIG. 7, the driving cord 65 is drawn from the upright top of the pulley tackle 62, so that the driving cord 65 could be disposed right down the linking pipe 52. A first groove 551 is disposed away from the buckling orifice 550 of the blocking member 55 for the cord to slickly pass through and for lessoning the damage opportunity of the driving cord 65 in the base 10. Preferably, the first groove 551 is preferably defined along the surface of the blocking member for ensuring a stronger rolling strength of the blocking member and decreasing the difficulty in processing. Besides positioning the first groove along the entire blocking member, a second groove 552 could be partially defined. Referring to FIG. 10, when the second groove 552 is adopted, the second groove 552 is extended from a lower portion of the blocking member 55 to a middle portion of the same. Concurrently, in the middle portion of the blocking member 55, the second groove 552 communicates with an axial aperture of the blocking member via an aperture 553. Whereby, after passing through the second groove 552, the driving cord 65 would thence penetrate the aperture 553 to the axial aperture of the blocking member and finally connect with the upper accommodation through the through hole of the linking pipe. In order to keep an identical movement to the cords, the first and second grooves 551, 552 are preferably defined parallel to the second axis of the blocking member 55.

The present invention takes advantage of hiding the driving cord 65 in the inner space in the support 1 to achieve a preferable operation. Moreover, the buckle or other parts of the umbrella would not interfere with each other, so that the open and close process of the umbrella is ensured to perform like the conventional; other demanding parts are not required, either. Therefore, the protective device can be assured to perform efficiently, and the developing cost is also effectively saved.

The present invention is not limited by abovementioned embodiments and drawings. Appropriate changes or modification to the disclosure by the person skilled in the art still belongs to the claimed scope.

I claim:

1. A protective improvement for a collapsible umbrella, comprising

I) telescopic umbrella support (1), including i) an outer pipe (11), a center pipe (12), and an inner pipe (13) telescopically coupled with each other;

ii) a propelling spring (14) disposed therein for correspondingly driving the outer pipe (11), the center pipe (12), and the inner pipe (13); and iii) a base (10) disposed at a bottom of the inner pipe (13), including a button (59) for a user to press manually in triggering a spring knurl (562) in displacement when opening the collapsible umbrella, and in triggering a buckle (54) for departing from a buckling orifice (550) when closing the collapsible umbrella; and a slippery block (64) for rotating a clutch disc (63) by compressing a protrusion (632) of the clutch disc (63), which in turn squeezes a spring sheet (631), further including a nail (642), fixed on the base (10) in an opening (641), for restricting a longitudinal movement of the slippery block (64) in a blocking member (55); and a relocating spring (643), disposed under the slippery block (64);

II) an upper accommodation (3) disposed on a top of the outer pipe (11);

III) a lower accommodation (4) movably disposed outside the outer pipe (11);

IV) a plurality of collapsible umbrella ribs (2), connected to the telescopic umbrella support (1) via the upper accommodation (3) and the lower accommodation (4);

V) a pulling cord (53), contained in a linking pipe (52), for pulling up the lower accommodation (4) and opening up the plurality of collapsible umbrella ribs (2) when a user opens the collapsible umbrella, and for stopping from pulling up the lower accommodation (4) when closing the umbrella; and VI) a driving cord (65), contained in the linking pipe (52), characterized by i) having one end thereof fixed to a pulley tackle (62) and having the other end thereof fixed to the upper accommodation (3), ii) having said driving cord (65) disposed in between said pulley tackle (62) and said upper accommodation (3) being hidden in the umbrella support (1), and iii) having said driving cord (65) after being drawn from the pulley tackle (62), disposed between the blocking member (55) and the umbrella support (1), then, pass through of the linking pipe (52), and finally fixed to the upper accommodation (3), wherein a spacer (521) is axially disposed within the linking pipe (52), and for separating the driving cord (65) from the pulling cord (53) to facilitate an independent and non-overlapping working space of the driving cord (65) and the pulling cord (53), wherein said blocking member (55) includes a buckling orifice; said collapsible umbrella further has a buckle for cooperating with said buckling orifice;

a first groove defined on an outer periphery of said blocking member is positioned away from said buckling orifice for said driving cord to penetrate.

2. The protective improvement on a collapsible umbrella as claimed in claim 1, wherein said spacer is a piece of blocking spacer stretchingly disposed within.

3. The protective improvement on a collapsible umbrella as claimed in claim 1, wherein, said groove is defined parallel to an axis of said blocking member.

4. The protective improvement on a collapsible umbrella as claimed in claim 1, wherein, said groove is defined along the entire outer periphery of said blocking member.

5. The protective improvement on a collapsible umbrella as claimed in claim 1, wherein, said groove is defined along a partial outer periphery of said blocking member; and said blocking member includes an aperture defined on an end portion of said groove for communicating with an axial aperture of said blocking member.

* * * * *